US005253863A

United States Patent [19]

Brewster, Jr.

[11] Patent Number: 5,253,863

[45] Date of Patent: Oct. 19, 1993

[54] PORTABLE SHEET FEEDING APPARATUS

[75] Inventor: William H. Brewster, Jr., Fairfield, Conn.

[73] Assignee: Pitney Bowes Inc., Stamford, Conn.

[21] Appl. No.: 979,973

[22] Filed: Nov. 23, 1992

[51] Int. Cl.[5] ..... B65H 5/02

[52] U.S. Cl. ..... 271/265; 271/275; 271/902

[58] Field of Search ..... 271/265, 275, 902

[56] References Cited

U.S. PATENT DOCUMENTS 4,512,562 4/1985 Moll ..... 271/13 X
5,035,415 7/1991 Lee ..... 271/265
5,149,081 9/1992 Greive ..... 271/275 X

*Primary Examiner*—Richard A. Schacher
*Attorney, Agent, or Firm*—Donald P. Walker; Melvin J. Scolnick

[57] ABSTRACT

Apparatus for transporting a sheet comprising, a frame including an elongate generally rectangularly-shaped upper wall having opposite ends, at least one endless belt looped about the upper wall, the at least one belt including a belt run overlaying the upper wall and extending longitudinally of the length thereof between the opposite upper wall ends, a d.c. motor supported by the frame and connected for driving the at least one belt in opposite directions, structure for connecting the apparatus to a source of supply of a.c. power, the connecting structure including a power switch operable for energizing the apparatus, structure for controlling energization of the motor, the controlling structure including a two position switch supported by the frame, the switch selectively actuatable for energizing the motor to drive the at least one belt in either of the opposite directions for moving the belt run(s) thereof in either direction between the opposite upper wall ends, the controlling structure including structure for sensing a sheet fed to the upper wall and thus to the belt run(s), the sensing structure including a sensor removably connectable to different positions on the apparatus for sensing sheets fed from different directions toward the belt run(s), and the controlling structure including structure responsive to the sensing structure sensing a sheet for energizing the motor.

13 Claims, 3 Drawing Sheets

PORTABLE SHEET FEEDING APPARATUS

BACKGROUND OF THE INVENTION

This invention is generally concerned with portable sheet feeding apparatus including structure for facilitating the use and operation thereof in a wide variety of applications.

As shown in U.S. Pat. No, 4,512,562, it is known in the art to provide sheet transporting apparatus including a frame for supporting the various components thereof, including an elongate, rectangularly-shaped, upper wall having opposed ends, and a plurality of belts which are looped about the upper wall to provide a corresponding number of belt runs which extend between the opposite ends of the upper wall and are disposed in overlying relationship therewith, and a motor connected to a plurality of roller engaging the belts for movement thereof. Moreover, as discussed in the '562 patent, it is known to provide structure for detecting the presence or absence of sheets fed to the belts and to adjust the belt speeds in response thereto to conform the belt speed to that of the sheets fed thereto. On the other hand, the '562 patent is silent regarding the provision of structures which enhance the versatility of the apparatus for use in combination with different types of sheet processing structures. Accordingly:

an object of the invention is to provide improved portable sheet feeding apparatus;

another object is to provide portable sheet transporting apparatus including a frame, and including sheet sensing structure removably attachable in various positions on the frame to accommodate use of the apparatus with different sheet processing structures;

another object is to provide portable sheet transporting apparatus which includes a frame and a plurality of sheet feeding belts, and includes a sheet receiving tray removably attachable to the frame for location at either of the opposite ends of the apparatus for guiding sheets fed to the frame into engagement with the belts;

another object is to provide portable sheet transporting apparatus including a frame and a plurality of sheet feeding belts, and including a sheet stacking tray removably attachable to the frame for location at either of the opposite ends of the frame for stacking sheets fed thereto by the belts; and another object is to provide portable sheet transporting apparatus including a control circuit for facilitating the use of the apparatus with different sheet processing structures.

BRIEF DESCRIPTION OF THE DRAWINGS

As shown in the drawings where in like reference numerals designate like or corresponding parts throughout the several views.

SUMMARY OF THE INVENTION

Apparatus for transporting a sheet comprising, a frame including an elongate generally rectangularly-shaped upper wall having opposite ends, at least one endless belt looped about the upper wall, the at least one belt including a belt run overlaying the upper wall and extending longitudinally of the length thereof between the opposite upper wall ends, a d.c. motor supported by the frame and connected for driving the at least one belt in opposite directions, means for connecting the apparatus to a source of supply of a.c. power, the connecting means including a power switch operable for energizing the apparatus, means for controlling energization of the motor, the controlling means including a two position switch supported by the frame, the switch selectively actuatable for energizing the motor to drive the at least one belt in either of the opposite directions for moving the belt run(s) thereof in either direction between the opposite upper wall ends, the controlling means including means for sensing a sheet fed to the upper wall and thus to the belt run(s), the sensing means including a sensor removably connectable to different positions on the apparatus for sensing sheets fed from different directions toward the belt run(s), and the controlling means including means responsive to the sensing means sensing a sheet for energizing the motor.

DESCRIPTION OF THE PREFERRED EMBODIMENTS

Figure 1:
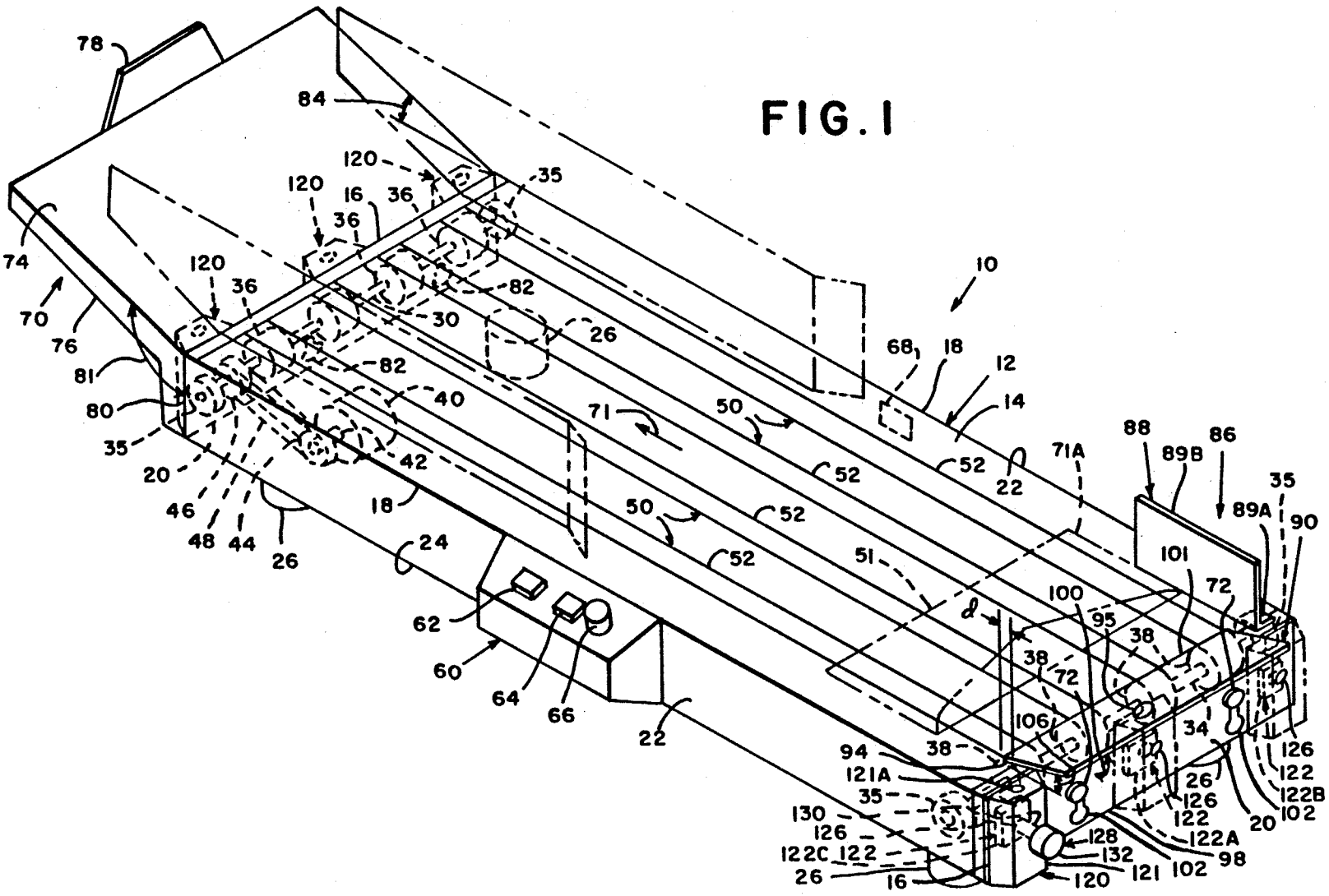
FIG. 1 is a perspective view of the portable sheet feeding apparatus according to the invention.
Figure 2A:
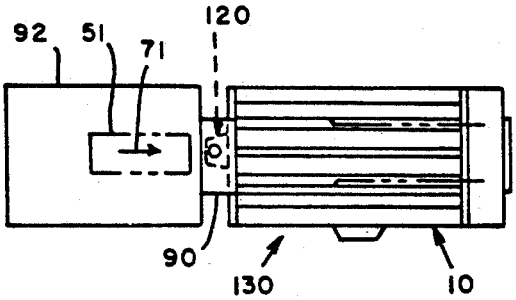
FIGS. 2A, 2B, 2C, 2D, 2E and 2F are schematic top plan views of the portable sheet feeding apparatus of FIG. 1 arranged in various system configurations with structure for feeding sheets thereto.
Figure 2B:
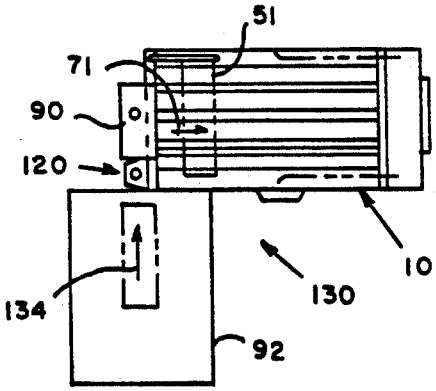
Figure 2C:
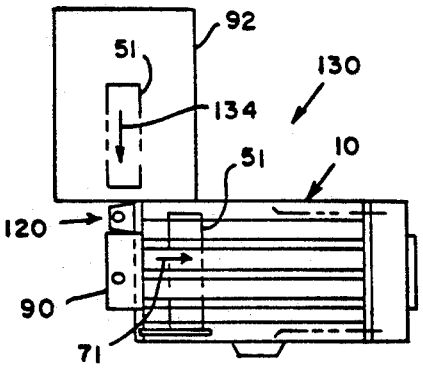
Figure 2D:
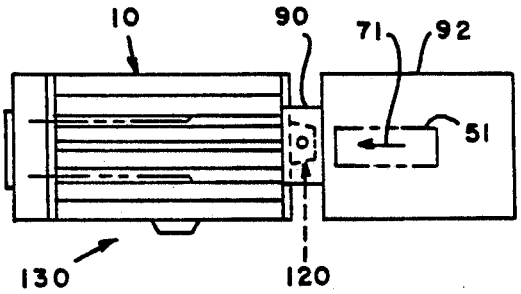
Figure 2E:
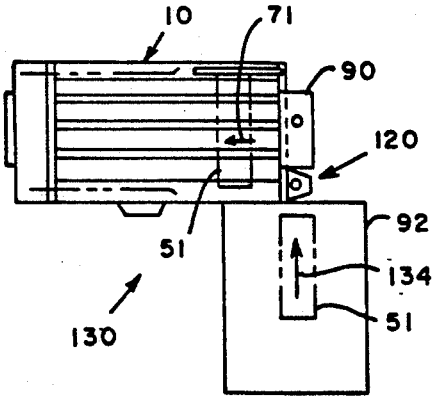
Figure 2F:
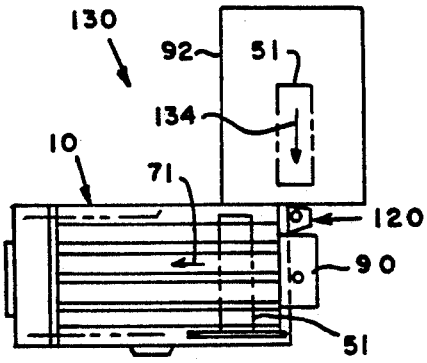

As shown in FIG. 1, according to the invention the portable sheet transporting apparatus 10 includes a frame 12 having a substantially rectangularly-shaped upper wall 14. The upper wall 14 has opposite ends 16 and opposite, longitudinally extending sides 18. In addition, the frame 12 includes a pair of elongate, oppositely disposed, end skirt walls 20, respectively depending from the upper wall ends 16, and a pair of elongate, oppositely disposed, side skirt walls 22, respectively depending from the upper wall sides 18. In addition, the frame 12 preferably includes an elongate, substantially rectangularly-shaped, lower wall 24 extending between the skirt walls, 20 and 22, and includes a plurality of leg members 26 depending from the lower wall 24 and dimensioned for supporting the frame 12 for positioning the upper wall 14 in a substantially horizontally-extending plane.

The sheet transporting apparatus 10 (FIG. 1) additionally includes oppositely spaced drive and idler shafts, 30 and 34, extending between the opposed side skirt walls 22 and conventionally rotatably connected thereto, as by means of bearings 35 connected to the side skirt walls 22. Further, the apparatus 10 includes at least one, and preferably a plurality of, drive rollers 36, which are respectively fixedly mounted on the drive shaft 30 for rotation thereby, and includes at least one, and preferably a plurality of, idler rollers 38, which are respectively fixedly mounted on the idler shaft 34 for rotation thereof. In addition, the apparatus 10 preferably includes a d.c. motor 40 which is conventionally fixedly attached to the upper wall 14 and has an output shaft 42. Moreover, the apparatus 10 includes a pinion gear pulley 44, which is conventionally fixedly connected to the motor output shaft 42 for rotation thereby, and includes a drive shaft gear pulley 46, which is conventionally fixedly mounted on the drive shaft 30 for rotation thereof. And, the apparatus 10 includes a conventional gear belt 48, which is looped about the motor pinion gear pulley 44 and drive shaft pulley 46 for transmitting motive power from the motor 40 to the drive shaft 30 and thus to the drive rollers 36. Still further, the apparatus 10 includes at least one, and preferably a plurality of, sheet transporting belt(s) 50 which are each looped about oppositely located drive and idler rollers, 36 and 38, and, in addition about the frame's upper wall 14 so as to define an elongate belt run 52 extending between the opposite ends 16 of the upper wall 14 and in overlaying relationship therewith.

The sheet transporting apparatus 10 (FIG. 1) additionally includes a control panel 60 which is suitably connected to one of the side skirt walls 22 so as to extend laterally thereof and to act as a support for a power on/off switch 62, having one position ("on"), wherein the apparatus 10 is energized, and another position ("off") wherein the apparatus 10 is deenergized. In addition, the control panel 60 supports a belt run/sens switch 64 having one position ("run") wherein the belt(s) 50 are continuously driven, and another position "sens" wherein the belt(s) 50 are driven in response to a sheet 51, including an envelope, being sensed as hereinafter discussed. Further, the control panel 60 supports a belt speed control rheostat 66 which is manually actuatable for selectively adjusting the speed of the belt(s) 50. Preferably, the apparatus 10 also includes a belt direction control switch 68, which is conventionally connected to the opposite side skirt wall 22 of the frame 12 and has one position wherein the belt(s) 50 are driven in one direction and another position wherein the belt(s) 50 are driven in the opposite direction.

Moreover, the sheet transporting apparatus 10 (FIG. 1) preferably includes an output sheet stacking tray 70, which is removably connected to either end 16 of the upper wall 14 for receiving respective sheets 51, fed downstream in a path of travel 71 on the belt run(s) 52. To that end, each of the end skirt walls 20 has a plurality of studs 72, which are spaced apart from one another and extend from each of the end skirt walls 20 for supporting the stacking tray 70. And, the stacking tray 70, which includes a bottom wall 74, oppositely spaced depending side walls 76 and an upright rear wall 78, preferably includes a depending front wall 80, which forms an obtuse angle 81 of substantially one hundred and five degrees (105°) with respect to the tray's bottom wall 74 and has a plurality of apertures 82 formed therein for receiving the studs 72 to mount the tray 70 to the frame 12. As thus constructed and arranged, when the tray 70 is mounted to the frame 14, the tray's bottom wall 74 angularly extends upwardly and outwardly from the frame's upper wall 14 at an angle 84 of substantially fifteen degrees (15°).

In addition, the sheet transporting apparatus 10 (FIG. 1) preferably includes input sheet guiding structure 86, including an input sheet feed stop 88, which is magnetically removably mountable on the frame upper wall 14, and an input sheet guiding tray 90, which is removably connectable to either end 16 of the upper wall 14 for receiving sheets 51 fed toward the belt run(s) 52 from various sheet processing structures 92 (FIGS. 2A–2F) with which the transporting apparatus 10 may be associated. The input sheet feed stop 88 (FIG. 1) preferably includes, a base portion 89A which is magnetically attractable to the upper wall 14 for mounting thereon, and an upright wall portion 89B extending from the base portion 89A. The input sheet guiding tray 90 preferably includes a bottom wall 94 having an aperture 95 formed therein substantially centrally thereof, and, in addition, includes a supporting wall 98 which depends from the bottom wall 94 and forms therewith an obtuse angle 100 of substantially one hundred and twenty degrees (120°). Thus the input tray's bottom wall 94 has a lower end 101. The supporting wall 98, which includes a plurality of apertures 102 formed therein and located at spaced intervals in the supporting wall 98 corresponding to the spacing of the studs 72, is marginally spaced from the bottom wall's lower end 101 a predetermined distance "d". As thus constructed and arranged, when the input guiding tray 90 is mounted on the studs 72, extending from either of the end skirt walls 20, the tray's bottom wall lower end 101 is disposed in overhanging relationship with the belt run(s) 52 for guiding respective sheets 51 fed to the tray 90 into engagement with the belt run(s) 52. Moreover, as thus constructed and arranged, the input sheet guiding tray 90 is removably connectable to the skirt wall 20 which is opposite to the skirt wall 20 to which the output stacking tray 70 is removably attached. And, when attached to the frame 12, the input sheet guiding tray's bottom wall 94 angularly extends upwardly and outwardly from the frame 12 at an angle 106 of substantially thirty degrees (30°) with respect to the frame's upper wall 14. Further, for registering sheets 51 fed to the belt run(s) 52, when such sheets 51 are fed there to in a direction extending transversely of the path of travel 71 of the belt run(s) 52, the sheet feed stop 88 may be removably magnetically mounted on the frame's upper wall 14 in any suitable position for stopping transverse motion of a sheet 51 on the input shoot guiding tray 90 and registering the leading edge 71A of the sheet 51 in the sheet feeding direction defined by the belt run(s) 52.

As shown in FIG. 1, the apparatus 10 additionally includes sheet sensing structure 120 including a housing 121 removably attachable to the frame 12, and, more particularly to each of the end skirt walls 20, in a plurality of locations for sensing sheets 51 fed thereover to the belt run(s) 52. To that end, the skirt walls, 20 and 22, each include a plurality of sensing structure supporting pads or blocks 122 connected to the inner surface of the respective end skirt walls 20, at a plurality of predetermined locations, respectively designated 122A, 122B and 122C. The block position 122A is located on each of the opposite end skirt walls 20 substantially midway between the side skirt walls 22. And the positions 122B and 122C are respectively located on opposite sides of the block position 122A, at the opposite ends of each of end skirt walls 20. In addition, the skirt walls 20 each include three (3) internally threaded apertures 126 formed therein and extending substantially through the center of each of the blocks 122. And, the sensing structure 120 includes a mounting screw 128, which is conventionally carried by the sensing structure housing 121. The mounting screw 128 has an elongate externally threaded shaft portion 130, and has a knurled free-end portion 132 for manually grasping the screw 128 and threading the shaft portion 130 into the appropriate internally threaded aperture 126 of the appropriate frame skirt wall 20, for removably mounting the sensing structure housing 121 to the frame 12. For sensing respective sheets 51 fed over the sensing structure housing 121, the housing 121 includes an opening 121A formed therein through which light 175A (FIG. 3) from a light emitting diode 172 may initially pass, via the input tray aperture 95 (FIG. 1), for impinging upon a sheet 51, and thereafter pass upon being reflected from the sheet 51 via the input tray aperture 95.

As shown in FIGS. 2A through 2F inclusive, the sheet transporting apparatus 10 is constructed and arranged as hereinbefore discussed to permit either end thereof to be positioned relative to any type of sheet processing apparatus 92 which includes output sheet feeding structure, such as a printer, inserter, postage meter, copier or facsimile machine, or the like, for configuring a sheet handling system 130 to a customer's floor space and operator convenience needs as well as matching whatever may be the output sheet feeding characteristics of the sheet processing structure 92 with which the sheet transporting apparatus 10 is associated. In this connection it is noted that use of the input sheet guiding tray 90 in a system configuration wherein the direction 134 of sheet feeding from the associated sheet processing structure 92 is transverse to the direction of the path of travel 71 of sheets 51 fed by the sheet transporting apparatus 10, solves a long-standing problem of ensuring that such sheets 51 are properly oriented relative to the path of travel 71 when fed thereby. Since the sheets 51 are initially guided over the belt(s) 50 by the tray 90, for feeding in the transverse direction 134 to the sheet transporting apparatus 10, before sliding downwardly on the tray 90 under the influence of gravity and into feeding engagement by the belt run(s) 52.

Figure 3:
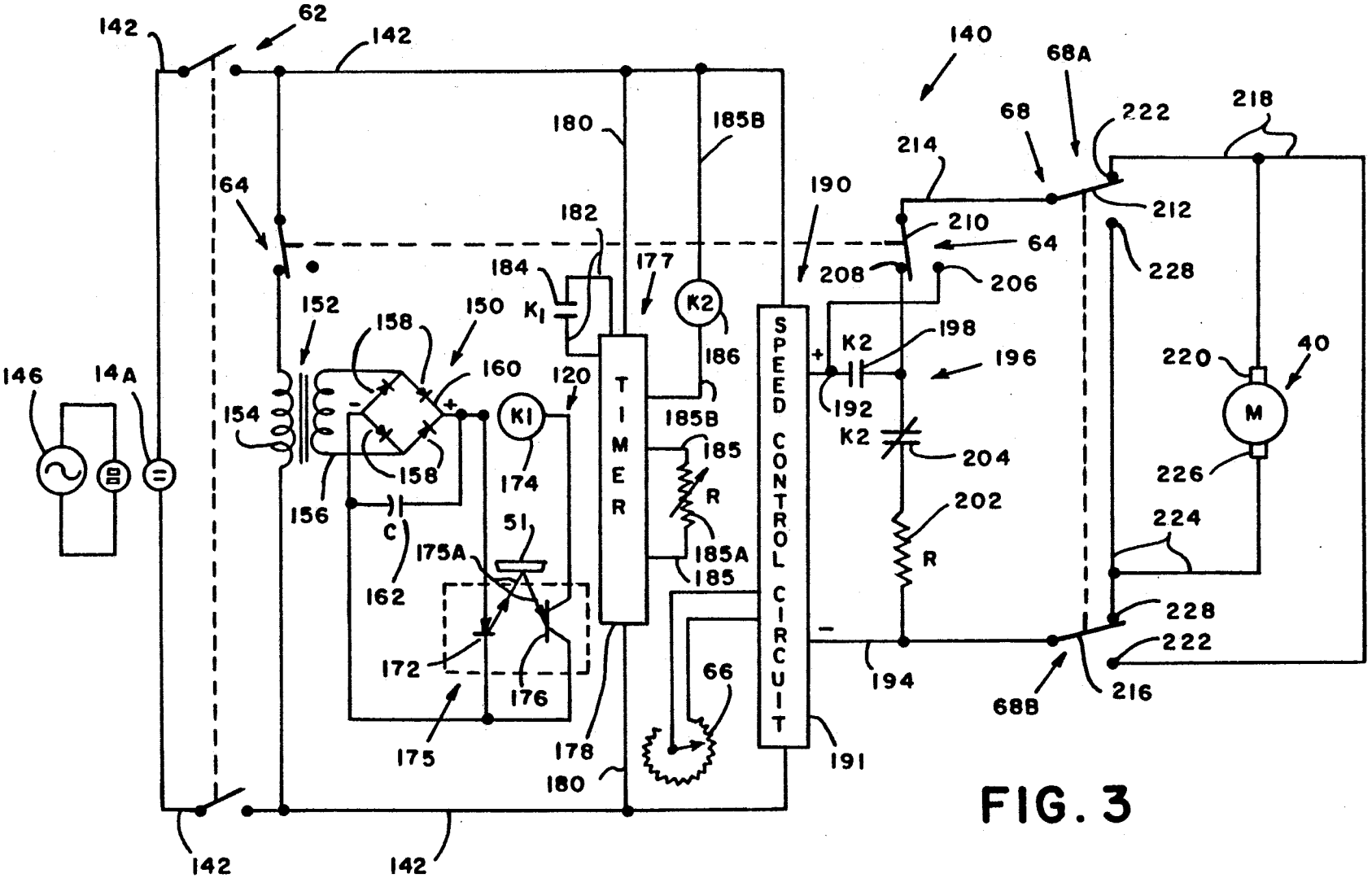
FIG. 3 is a schematic diagram of the electrical control circuit of the portable sheet feeding apparatus of FIG. 1.

For controlling operation of the sheet transporting apparatus 10 (FIG. 1), the apparatus 10 includes the motor 40, power on/off switch 62, belt run/sensor switch 64, belt speed control rheostat 66, belt direction control switch 68 and sensing structure 120, electrically connected in the control circuit 140 shown in FIG. 3. As shown therein, the power on/off switch 62 is a two pole single throw switch having the poles thereof electrically connected in a pair of a.c. input lines 142. One side of the power switch 62 is conventionally connectable by means of a suitable plug 144 to a local source of supply of a.c. power 146, and the other side of the switch 62 is connected to energize the control circuit 140, and thus the shoot transporting apparatus 10, in response to closure of the switch 62 to the "on" position thereof. The circuit 140 additionally includes a conventional d.c. power supply 150 including a suitable transformer 152 having primary and secondary windings, 154 and 156. The power supply 150 also includes a plurality of rectifiers 158 arranged in a full-wave bridge circuit 160, and includes a filter capacitor 162. The transformer primary winding 154 is connected across the a.c. input lines 142 via a switching contact of the belt run/sens switch 64 for energization of the primary winding when the switch 64 is positioned in the "sens" position thereof. The transformer secondary winding 156 is connected across the input of the bridge circuit 160 and the filter capacitor 162 is connected across the output of the bridge circuit 160. The d.c. output from the power supply 150, and thus the output across the capacitor 162, is connected for d.c. energization of the sensing structure 120. In this connection, the sensing structure 120 includes the light emitting diode (LED) 172, connected in parallel with the capacitor 162, and includes a series connected low power relay 174 and light responsive solid state switch 176 which are connected in parallel with the LED 172. In operation, the LED 172 and switch 176 are conventionally constructed and arranged to act as a reflective sensor 175. Thus the switch 176 is operable to energize the relay 174 in response to light 175A being emitted from the LED 172 and reflected from a sheet 51 to impinge upon the light responsive switch 176 for energization thereof.

The control circuit 140 (FIG. 3) additionally includes a time-out circuit 177 including a a conventional solid state timer 178 which includes two leads 180 connected across the a.c. input lines 142 for energization thereof, two leads 182 connected across a normally open contact 184 of the low power relay 174, two leads 185 connected across a variable resistor 185A which may be adjusted for selecting a suitable time out time interval, and one lead 185B connected to one of the a.c. input lines 142 via a high power relay 186 for energization thereof in response to energization of the timer 178. As thus constructed and arranged, the high power relay 186 is energized upon closure of the low power relay contact 184, but not deenergized upon opening of the low power relay contact. Rather, the high power relay 186 is deenergized after the lapse of a predetermined time interval corresponding to the selected adjustment of the variable resistor 185, from the opening of the low power relay contact 184, to ensure that the belt(s) 51 continue to be driven during time intervals between successive sheets 51 being fed to the belt run(s) 52.

The circuit 140 (FIG. 3) further includes a speed control circuit 190 comprising a conventional solid state A.C. to D.C. power converter 191, connected across the a.c. lines 142. The converter 191 includes suitable rectification and chopper circuits (not shown). And the speed control circuit 190 includes the rheostat 66, which is conventionally connected to the converter 191. In operation, the rheostat 66 (FIG. 1) is manually actuatable for selectively increasing and decreasing the d.c. output voltage provided across the positive and negative output leads, 192 and 194, of the speed control circuit 190 for controlling the sheet feeding speed of the belt run(s) 52. Moreover, the control circuit 140 includes a motor drive and dynamic braking circuit 196, including a normally open contact 198 of the high power relay 186, which contact 198 is connected in series with the positive output lead 192 from the speed control circuit 190 for energizing the d.c. motor 40 to drive the same in response to energization of the relay 186, and including a series connected resistor 202 and normally closed contact 204 of the high power relay 186, which resistor 202 is connected across the d.c. motor 40 when the relay contact 198 is opened and the relay contact 202 is closed, for dynamically braking the d.c. motor 40. Further, the control circuit 140 includes one of the switches of the belt run/sens switch 64, having one closure contact 206 thereof connected to the positive output lead 192 of the speed control circuit and having the other contact 208 thereof connected between the high power relay switching contacts, 198 and 204, and having the pole 210 thereof connected to one of a motor drive leads 212.

Further, the control circuit 140 (FIG. 3) includes the belt direction control switch 68, which includes two ganged single poled double throw switches,, 68A and 68B, having one pole 212 thereof connected to a motor drive lead 214 for providing positive d.c. power to the motor 40 and the other pole 216 thereof connected to the negative power lead 194 from the speed control circuit 190. Moreover, the switch 68 includes positive power leads 218 connected between one side 220 of the motor 40 and one contact 222 of each of the single pole switches and negative power leads 224 connected between the other side 226 of the motor 40 and the other contacts 228 of such switches 68A and 68B, in a manner such that closure of the switch 68 in one position applies positive power to one side 220 of the motor 40 and negatively grounds the other side 226 thereof, and closure of the switch 68 in the other position applies positive power to the other side 226 of the motor 40 and negatively grounds the opposite side 220 thereof, whereby the motor 40 may be energized for driving the belts 51 (FIG. 1) in either direction in response selected to actuation of the switch 68.

What is claimed is:

1. Apparatus for transporting a sheet comprising:

a. a frame including an elongate generally rectangularly-shaped upper wall having opposite ends;

b. at least one endless belt looped about the upper wall, the at least one belt including a belt run overlaying the upper wall and extending longitudinally of the length thereof between the opposite upper wall ends;

c. a d.c. motor supported by the frame and connected for driving the at least one belt in opposite directions;

d. means for connecting the apparatus to a source of supply of a.c. power, the connecting means including a power switch operable for energizing the apparatus;

e. means for controlling energization of the motor, the controlling means including a two position switch supported by the frame, the switch selectively actuatable for energizing the motor to drive the at least one belt in either of the opposite directions for moving the belt run(s) thereof in either direction between the opposite upper wall ends, the controlling means including means for sensing a sheet fed to the upper wall and thus to the belt run(s), the sensing means including a sensor removably connectable to different positions on the apparatus for sensing sheets fed from different directions toward the belt run(s), and the controlling means including means responsive to the sensing means sensing a sheet for energizing the motor.

2. The apparatus according to claim 1, wherein the sensing means includes a reflective sensor removably attachable to the apparatus alongside of either of the opposite upper wall ends for sensing a sheet fed thereover and in either direction of movement of the belt run(s).

3. The apparatus according to claim 1, wherein the at least one belt in a plurality of belts and the belt runs thereof extend parallel to one another.

4. The apparatus according to claim 1, wherein the sensing the sensing means includes a reflective sensor removably attachable to the framework alongside of either of the opposite upper wall ends for sensing a sheet fed thereover and in either direction transversely of the longitudinal length of the belt run(s).

5. The apparatus according to claim 1, wherein the frame includes oppositely disposed skirt walls respectively depending from the opposite upper wall ends, the sensing means including a sensor removably connectable to either of the skirt walls for sensing a sheet fed thereover to the belt run(s), and the switch is a two position switch having a first position for causing energization of the motor to move the at least one belt in one of the directions and having a second position for causing energization of the motor to move the at least one belt in the other of the directions.

6. The apparatus according to claim 1, wherein the frame includes oppositely disposed skirt walls respectively depending from the opposite ends of the upper wall, and the apparatus including a sheet output stacking tray removably connectable to either of the oppositely disposed skirt walls.

7. The apparatus according to claim 1, wherein the frame includes oppositely disposed skirt walls respectively depending from the opposite end of the upper wall, and the apparatus including a sheet input guiding tray removably connectable to either of the oppositely disposed skirt walls.

8. The apparatus according to claim 5, wherein the means for controlling energization includes means for overriding the sensing means, and the overriding means including a selectively actuatable switch operable for causing the motor to be continuously energized for driving the belt(s) in the selected direction.

9. The apparatus according to claim 1, including means for controlling the speed of the motor and thus the speed of the belt(s).

10. The apparatus according to claim 7, wherein the input sheet input guiding tray includes a bottom wall forming an angle of substantially thirty degrees with respect to the frame upper wall for guiding sheets fed thereto downwardly toward the belt run(s).

11. The apparatus according to claim 7, wherein the sheet input guiding tray includes a bottom wall having a lower end disposed in overhanging relationship with the belt run(s) when connected to either of the skirt walls.

12. The apparatus according to claim 7, wherein the input sheet guiding tray includes an aperture formed therein substantially centrally thereof to permit light from the sensing means when connected therebeneath to pass therethrough to impinge upon a sheet fed to the tray and to permit reflected light from a sheet to pass therethrough to the sensing means.

13. The apparatus according to claim 11 including a stop wall removably mountable on the upper wall for stopping movement of a sheet fed to the belt run (s) in a direction extending transverse to the longitudinal length thereof to register an edge of the sheet in the direction of the longitudinal length of the belt run(s).

* * * * *